US010119505B2

(12) United States Patent
Oda et al.

(10) Patent No.: US 10,119,505 B2
(45) Date of Patent: Nov. 6, 2018

(54) HIGH PRESSURE PUMP

(71) Applicant: DENSO CORPORATION, Kariya, Aichi-pref. (JP)

(72) Inventors: Kaoru Oda, Kariya (JP); Shinichiro Koshimoto, Kariya (JP); Shinobu Oikawa, Kariya (JP)

(73) Assignee: DENSO CORPORATION, Kariya (JP)

( * ) Notice: Subject to any disclaimer, the term of this patent is extended or adjusted under 35 U.S.C. 154(b) by 303 days.

(21) Appl. No.: 15/198,036

(22) Filed: Jun. 30, 2016

(65) Prior Publication Data

US 2017/0002779 A1 Jan. 5, 2017

(30) Foreign Application Priority Data

Jul. 3, 2015 (JP) ..... 2015-134512

(51) Int. Cl.

| | |
|---|---|
| ***F02M 37/00*** | (2006.01) |
| ***F02M 63/00*** | (2006.01) |
| ***F02M 59/46*** | (2006.01) |
| ***F04B 19/22*** | (2006.01) |
| ***F04B 49/22*** | (2006.01) |
| ***F04B 53/14*** | (2006.01) |
| ***F04B 53/16*** | (2006.01) |

(Continued)

(52) U.S. Cl.

CPC ..... *F02M 37/0052* (2013.01); *F02M 37/06* (2013.01); *F02M 59/46* (2013.01); *F02M 63/005* (2013.01); *F04B 9/042* (2013.01); *F04B 17/03* (2013.01); *F04B 17/05* (2013.01); *F04B 19/22* (2013.01); *F04B 49/08* (2013.01); *F04B 49/22* (2013.01); *F04B 49/24* (2013.01); *F04B 53/10* (2013.01); *F04B 53/1087* (2013.01); *F04B 53/14* (2013.01); *F04B 53/16* (2013.01); *Y10T 137/7734* (2015.04)

(58) Field of Classification Search

CPC .... F02M 37/0052; F02M 37/06; F02M 59/46; F02M 63/005; F04B 9/042; F04B 53/10; F04B 53/14; F04B 53/16; F04B 53/1087; F04B 49/24; F04B 49/08; F04B 49/22; F04B 17/03; F04B 17/05; F04B 19/22; Y10T 137/7734; Y10T 137/7922–137/7939; F16K 17/042

USPC ..... 417/285, 306, 307, 440, 441; 251/297, 251/90

See application file for complete search history.

(56) References Cited

U.S. PATENT DOCUMENTS

| | | | | |
|---|---|---|---|---|
| 2007/0034262 | A1* | 2/2007 | Cozens | F04B 49/03 137/513 |
| 2009/0116976 | A1* | 5/2009 | Aritomi | F02M 63/0036 417/311 |
| 2009/0159054 | A1* | 6/2009 | Suzuki | F02M 59/16 123/506 |

* cited by examiner

*Primary Examiner* — Devon Kramer
*Assistant Examiner* — Christopher Brunjes
(74) *Attorney, Agent, or Firm* — Nixon & Vanderhye PC

(57) ABSTRACT

A high pressure pump includes a pressurization portion, a discharge portion, a body portion, a valve member, an urging member, valve hold member and a limiting portion. The body portion includes a relief passage, an inlet, a valve seat, and an outlet. The valve member includes a large diameter portion and a small diameter portion. The small diameter portion is located between the valve seat and the large diameter portion and has an outer diameter smaller than an outer diameter of the large diameter portion. The valve hold member surrounding and holding the large diameter portion. The limiting portion capable of limiting a motion of the valve hold member in a separation direction. According to (Continued)

this, a pressure in a fuel rail from extraordinarily increasing again after the relief valve is opened once.

10 Claims, 5 Drawing Sheets

(51) Int. Cl.

| | |
|---|---|
| ***F04B 53/10*** | (2006.01) |
| ***F02M 37/06*** | (2006.01) |
| ***F04B 9/04*** | (2006.01) |
| ***F04B 17/03*** | (2006.01) |
| ***F04B 17/05*** | (2006.01) |
| ***F04B 49/08*** | (2006.01) |
| ***F04B 49/24*** | (2006.01) |

HIGH PRESSURE PUMP

CROSS REFERENCE TO RELATED APPLICATION

This application is based on and incorporates herein by reference Japanese Patent Application No. 2015-134512 filed on Jul. 3, 2015.

TECHNICAL FIELD

The present disclosure relates to a high pressure pump.

BACKGROUND

Conventionally, a high pressure pump sending a high pressure fuel is provided in a fuel supply device supplying a fuel to an engine. A component, which has a volume for storing the high pressure fuel sent from the high pressure pump, is a fuel rail. Since a pressure in the fuel rail is maintained, the fuel is injected from an injector.

However, a failure of an adjustment valve included in the high pressure pump, for example, may cause an extraordinary high pressure higher than an acceptable range in the fuel rail, and the fuel rail and the injector may be damaged. A high pressure pump including a relief valve, which is opened when a pressure in a fuel rail extraordinarily increases, has been proposed in Patent Document 1 (JP 2009-114868 A). In the high pressure pump described in Patent Document 1, the pressure in the fuel rail can be decreased by opening the relief valve.

In the high pressure pump described in Patent Document 1, the pressure in the fuel rail decreases after the valve member opens the relief valve for a while, and an urging force becomes larger than a force that opens the relief valve. Therefore, the relief valve once opened is closed, and the relief valve is not opened again unless the pressure in the fuel rail increases up to a predetermined value. Consequently, the pressure in the fuel rail may extraordinarily increase again, and accordingly the fuel rail and the injector may be damaged.

SUMMARY

It is an objective of the present disclosure to provide a high pressure pump preventing a pressure in a fuel rail from extraordinarily increasing again after a relief valve is opened once.

According to an aspect of a high pressure pump of the present disclosure includes: a pressurization portion including a pressurization room whose volume is varied by a motion of a plunger to be capable of pressurizing a fuel; a discharge portion discharging the fuel pressurized in the pressurization room to a fuel rail; a body portion including a relief passage, an inlet, a valve seat and an outlet; a valve member including a large diameter portion and a small diameter portion, the small diameter portion being located between the valve seat and the large diameter portion and having an outer diameter smaller than an outer diameter of the large diameter portion, the small diameter portion contacting the valve seat so as to close the inlet of the body portion when a pressure in the downstream passage is below a predetermined pressure, the valve member moving apart from the valve seat in a separation direction so as to open the inlet of the body portion when the pressure in the downstream passage is at or above the predetermined pressure; an urging member urging the valve member toward the valve seat; a valve hold member surrounding and holding the large diameter portion; and a limiting portion capable of limiting a motion of the valve hold member in the separation direction. The inlet is an inlet of the body portion through which the fuel flows from a downstream passage located downstream of the discharge portion to an upstream passage located upstream of the discharge portion. The outlet is an outlet of the body portion through which the relief passage and the downstream passage communicate with each other. A valve seat is provided on a radially outer side of the inlet and has an annular shape.

According to this, when the pressure in the downstream passage increases extraordinarily, the valve member move apart from the valve seat and opens the inlet. The valve hold member moves apart from the valve seat together with the valve member. A motion of the valve hold member apart from the valve seat is limited by the limiting portion. The valve member moves in the separation direction relative to the valve hold member against a gripping force of the valve hold member. The valve member includes the small diameter portion being located between the valve seat and the large diameter portion and having the outer diameter smaller than the outer diameter of the large diameter portion. Accordingly, the valve hold member decreases in size in a radial direction by a gripping force.

When the valve member comes into contact with the valve seat after the valve member has moved in the separation direction, the valve member is stopped by an edge portion of the valve hold member facing in the separation direction. Consequently, the valve hold member is interposed between the valve member and the body portion, and the valve hold member prevents the valve member from contacting the valve seat. Accordingly, a pressure in the downstream passage is prevented from extraordinarily increasing.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
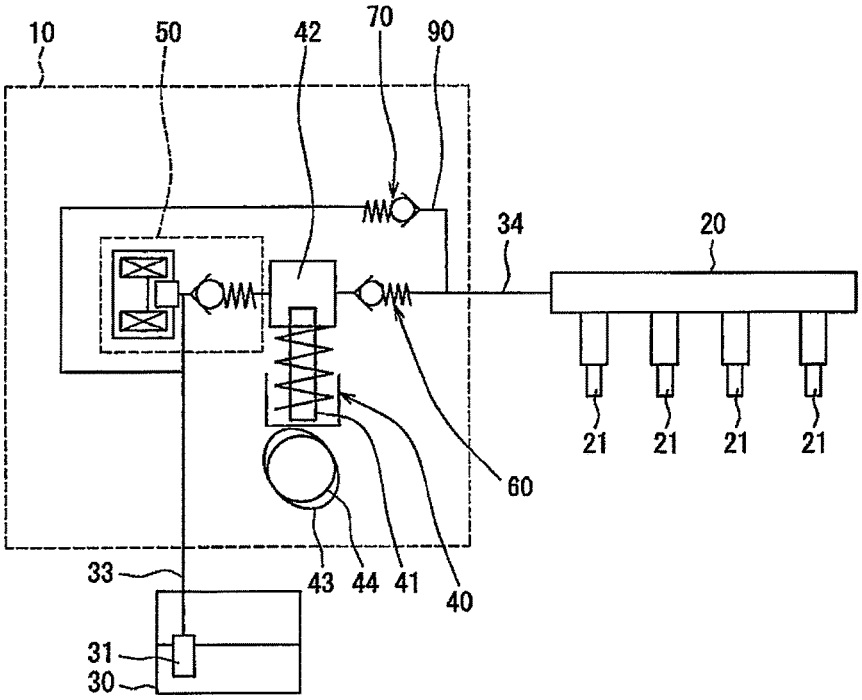
FIG. 1 is a diagram illustrating a high pressure pump according to a first embodiment of the present disclosure.

Embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A low pressure pump 31 pumping up a fuel is provided in a fuel tank 30 in which the fuel is stored. The low pressure pump 31 is driven by using a battery as a power source. The fuel discharged from the low pressure pump 31 is supplied to a high pressure pump 10 through a low pressure passage 33.

The high pressure pump 10 is a pump that includes a plunger 41 reciprocating in a pressurization room 42 having a circular cylindrical shape. The high pressure pump 10 draws and discharges a fuel by the reciprocation of the plunger 41. The plunger 41 is driven by a rotation of a cam 43 integrated with a camshaft 44 of an engine. An adjustment valve 50 is provided on an intake side of the high pressure pump 10. The adjustment valve 50 is a normally open type solenoid valve. In an intake process of the high pressure pump 10, the adjustment valve 50 is open, and a fuel is drawn into the pressurization room 42. The plunger 41 moves downward in the intake process. In a discharge process of the adjustment valve 50, a control portion controls a close period of the adjustment valve 50 to adjust an amount of a fuel discharged from the high pressure pump 10, and accordingly a fuel pressure (discharge pressure) is controlled. The plunger 41 moves upward in the discharge process. The control portion may control a valve close period corresponding to a range of a crankshaft position which is from a valve close timing, at which the adjustment valve 50 is closed, to a top dead center of the plunger 41.

When the fuel pressure is increased, the valve close timing (energization timing) of the adjustment valve 50 is set early so that the valve close period of the adjustment valve 50 is long, and accordingly the amount of the fuel discharged from the high pressure pump 10 is increased. When the fuel pressure is decreased, the valve close timing of the adjustment valve 50 is set late so that the valve close period of the adjustment valve 50 is short, and accordingly the amount of the fuel discharged from the high pressure pump 10 is decreased.

A discharge portion 60 preventing a discharged fuel from flowing back is provided on an outlet side of the high pressure pump 10. The fuel discharged from the high pressure pump 10 is sent to a fuel rail (high pressure fuel passage) 20 through a high pressure passage 34, and the fuel in the fuel rail 20 is distributed to an injector 21 attached to each cylinder of an engine. The high pressure pump 10 according to the present embodiment is installed to a vehicle.

The high pressure pump 10 further includes a fuel return passage 90 through which the fuel in the high pressure passage 34 and the fuel rail 20 is returned to the low pressure passage 33. A pressure adjustment portion 70 is provided in the fuel return passage 90. The pressure adjustment portion 70 includes valve member 71 that is opened when a fuel pressure in a high pressure fuel passage is higher than a predetermined upper limit pressure (35 MPa, for example).

According to this configuration, when the fuel pressure in both the high pressure passage 34 and the fuel rail 20 is higher than the upper limit pressure during an engine (the high pressure pump 10) driving, the valve member 71 is opened so that the fuel pressure in the high pressure passage 34 and the fuel in the fuel rail 20 is maintained to be at or below the upper limit pressure.

Next, the pressure adjustment portion (relief valve) 70 of the present embodiment will be described below referring to FIG. 2. The pressure adjustment portion 70 includes a body portion 73, a valve member 71, an urging member 77 and a holding member 72.

The body portion 73 has a bottomed and circular cylindrical shape. The body portion 73 is made of stainless steel, for example. The body portion 73 defines a downstream relief passage (relief passage) 731*a*. The body portion 73 defines an inlet 732*a* through which the downstream relief passage 731*a* and the high pressure passage 34 illustrated in FIG. 1 communicate with each other. The high pressure passage 34 may be a space on a downstream side. The body portion 73 defines an outlet 733*a* through which the downstream relief passage 731*a* and the low pressure passage 33 illustrated in FIG. 1 communicate with each other. The body portion 73 further defines an upstream relief passage 735*a* between the downstream relief passage 731*a* and the outlet 733*a*. The fuel flows into the pressure adjustment portion 70 through the inlet 732*a* and flows out through the outlet 733*a*. The low pressure passage 33 may be a space on an upstream side.

Specifically, the body portion 73 includes, in the cylinder portion thereof, a downstream passage defining portion (downstream relief passage defining portion) 731 that defines the relief passage 731*a* and an outlet defining portion 733 defining the outlet 733*a*. Moreover, the body portion 73 includes an inlet defining portion 732 defining the inlet 732*a* and an upstream passage defining portion (upstream relief passage defining portion) 735 defining the upstream relief passage 735*a*.

In the present embodiment, the inlet defining portion 732 is an inner wall surface of the body portion 73 defining the inlet 732*a*. The outlet defining portion 733 is an inner wall surface of the body portion 73 defining the outlet 733*a*. The downstream passage defining portion 731 is an inner wall surface of the body portion 73 defining the relief passage 731*a*. The upstream passage defining portion 735 is an inner wall surface of the body portion 73 defining the upstream relief passage 735*a*.

The inlet 732*a*, the downstream relief passage 731*a*, the upstream relief passage 735*a* and the outlet 733*a* are arranged in this order from the downstream side. In the present embodiment, the inlet 732*a* is provided in a surface intersecting with (perpendicular to) an axis of the body portion 73. The outlet 733*a* is provided on the upstream side of the inlet 732*a*. The downstream relief passage 731*a* is defined by the inner wall surface of the body portion 73 that is along the axial direction of the body portion 73. The upstream relief passage 735*a* is also defined by the inner wall surface of the body portion 73 that is along the axial direction of the body portion 73.

A diameter of the downstream relief passage 731*a* is larger than a diameter of the upstream relief passage 735*a*. The body portion 73 includes a limiting portion (limiting surface) 736 extending from an edge portion of the downstream passage defining portion 731 on the upstream side to an edge portion of the upstream passage defining portion 735 on the downstream side, and accordingly the limiting portion 736 connects the downstream passage defining portion 731 and the upstream passage defining portion 735. The limiting portion 736 extends from the inner wall of the body portion 73 toward the axis of the body portion 73. The limiting portion 736 may extend in a direction perpendicular to the axial direction of the body portion 73.

A valve seat 734 extending from an edge portion of the inlet defining portion 732 on the upstream side toward a radially outer side is provided on the body portion 73. The valve seat 734 may have an annular shape on the radially outer side in the edge portion of the inlet defining portion 732. The inlet 732*a* is an inlet through which the fuel flows into the pressure adjustment portion 70. The outlet 733*a* is an outlet through which the fuel flows out of the pressure adjustment portion 70.

The valve member 71, the urging member 77 and the holding member 72 are provided inside the body portion 73. The valve member 71 contacts the valve seat 734. A first end of the urging member 77 is fixed to (contacts) a surface of the valve member 71 opposite from a surface of the valve member 71 contacting the valve seat 734. The urging member 77 urges the valve member 71 toward the valve seat 734. A second end of the urging member 77 opposite from the first end fixed to the valve member 71 is fixed to (contacts) the holding member 72.

The valve member 71 comes into and out of contact with the valve seat 734 according to the fuel pressure in the high pressure passage 34. In the present embodiment, a direction in which the valve member 71 moves apart from the valve seat 734 is a separation direction, and a direction opposite to the separation direction is a contact direction. In the present embodiment, the separation direction is the same direction as an upstream direction. The contact direction is the same direction as a downstream direction.

The valve member 71 includes a front end portion 715 and an outer wall portion 713. The valve member 71 is made of stainless steel, for example, and has a circular cylindrical shape. The front end portion 715 and the outer wall portion 713 are arranged in this order from the contact direction toward the separation direction. The front end portion 715 and the outer wall portion 713 may be arranged in this order from the downstream side. In the present embodiment, a large diameter portion is the outer wall portion 713, and a small diameter portion is the front end portion 715.

A diameter of the outer wall portion 713 is larger than a diameter of the front end portion 715. The valve member 71 includes an engagement surface 716 extending from an edge portion of the outer wall portion 713 facing in the contact direction to an edge portion of the front end portion 715 facing in the separation direction, and accordingly the engagement surface 716 connects the outer wall portion 713 and the front end portion 715. The engagement surface 716 may extend outward from the front end portion 715.

The front end portion 715 includes a pressure receive surface 711 and a seating portion (valve seat portion) 718. The seating portion 718 contacts the valve seat 734, and accordingly the valve member 71 closes the inlet 732*a*.

The urging member 77 may be a coil spring, for example, and urges the valve member 71 toward the valve seat 734.

The holding member 72 is made of stainless steel and has a circular cylindrical shape. The holding member 72 is positioned apart by a predetermined distance from the valve member 71. The second end of the urging member 77 opposite from the first end fixed to the valve member 71 is fixed to the holding member 72.

Therefore, the valve member 71 is urged toward the valve seat 734 by the urging member 77 and the holding member 72. When a pressure of a fuel in the high pressure passage 34 communicating with the inlet 732*a* is below a predetermined pressure, the valve member 71 closes the inlet 732*a* by an urging force of the urging member 77. In other words, when the pressure of the fuel in the high pressure passage 34 communicating with the inlet 732*a* is at or above the predetermined pressure, the valve member 71 moves apart from the valve seat 734 and opens the inlet 732*a*.

A valve hold member 75 gripping (holding) an outer wall of the valve member 71 is located inside the body portion 73. Specifically, an inner wall surface of the valve hold member 75 grips an outer wall surface 712 of the outer wall portion 713 of the valve member 71. The valve hold member 75 is offset from the limiting portion 736 in the contact direction. The valve hold member 75 grips the valve member 71 in the downstream relief passage 731*a*. The valve hold member 75 may be located between the limiting portion 736 and the valve seat 734 in the axial direction of the pressure adjustment portion 70.

Therefore, when the pressure of the fuel in the high pressure passage 34 exceeds the predetermined pressure, and when the valve member 71 moves apart from the valve seat 734 in the separation direction, the valve hold member 75 moves together with the valve member 71. The valve hold member 75 may be located between the limiting portion 736 and the valve seat 734 in the axial direction of the body portion 73 of the pressure adjustment portion 70.

The limiting portion 736 limits a motion of the valve hold member 75 in the separation direction. Therefore, the valve member 71 moves in the separation direction relative to the valve hold member 75 against the gripping force of the valve hold member 75.

Subsequently, the valve member 71 moves in the separation direction, and accordingly the valve hold member 75 becomes not to be capable of gripping the outer wall surface 712. After the valve member 71 moves in the separation direction, the valve hold member 75 may come out of contact with the outer wall surface 712. Consequently, the valve hold member 75 decreases in size in a radial direction by its own gripping force, and accordingly the valve hold member 75 grips the front end portion 715 located between the outer wall portion 713 and the valve seat 734.

After the inlet 732*a* is opened, the pressure of the fuel in the high pressure passage 34 decreases, and accordingly the valve member 71 is urged toward the valve seat 734 by the urging force of the urging member 77. However, a motion of the valve member 71 in the contact direction is limited by the valve hold member 75 that has decreased in size in the radial direction.

Specifically, when the valve hold member 75 holds the front end portion 715, the engagement surface 716 of the valve member 71 comes into contact with an edge portion of the valve hold member 75 facing in the separation direction, and accordingly the motion of the valve member 71 in the contact direction is limited.

Figure 3:
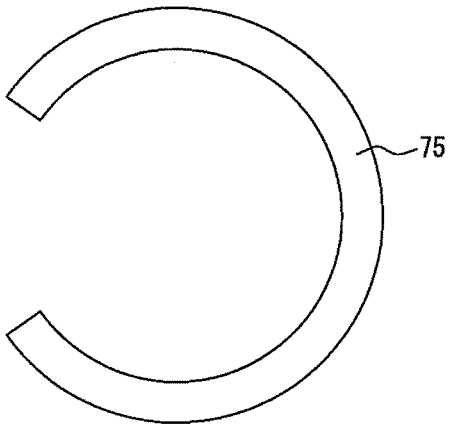
FIG. 3 is a diagram illustrating a valve hold member according to the first embodiment.
Figure 2:
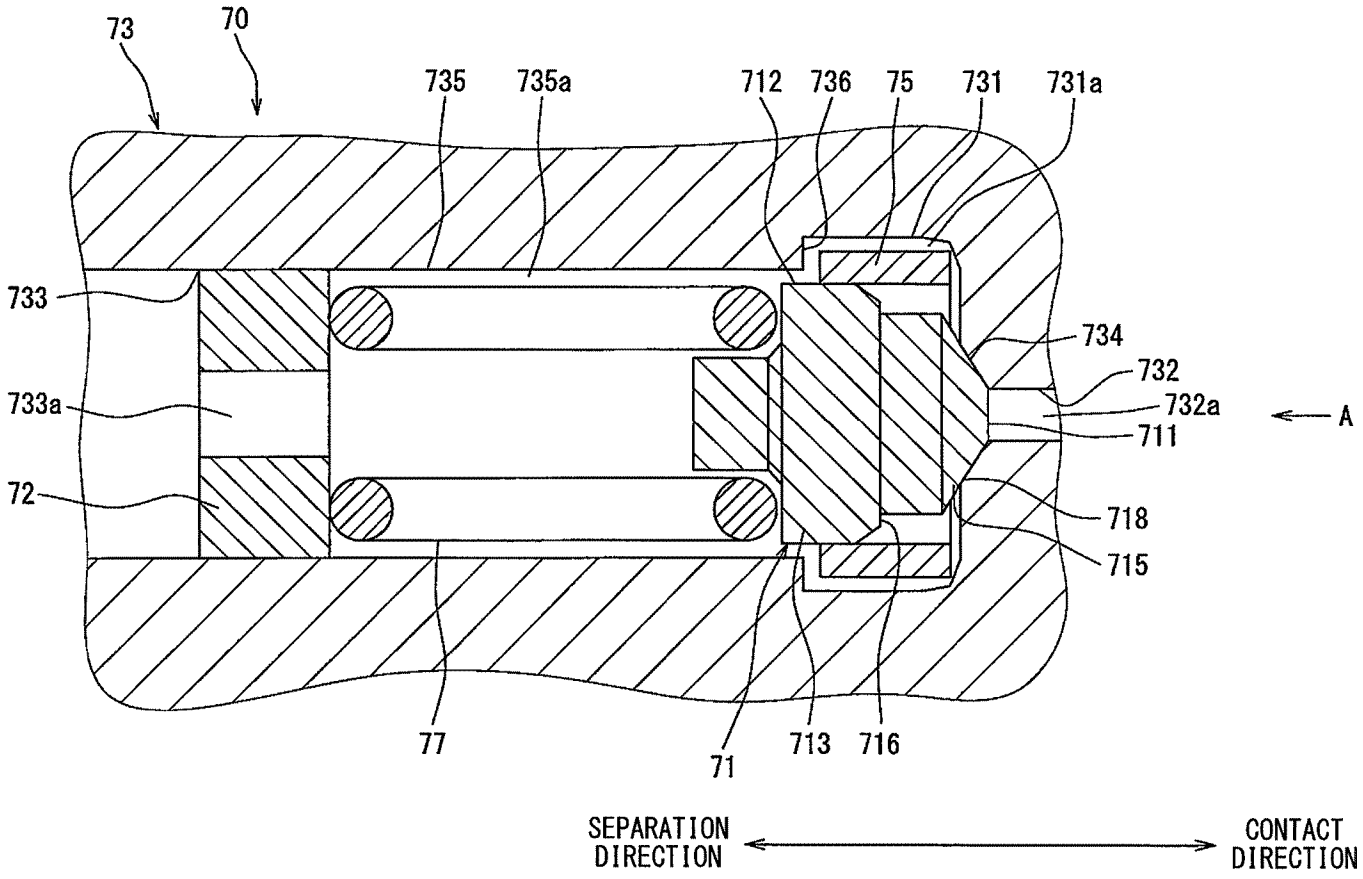
FIG. 2 is a diagram illustrating a pressure adjustment portion according to the first embodiment.
Figure 4:
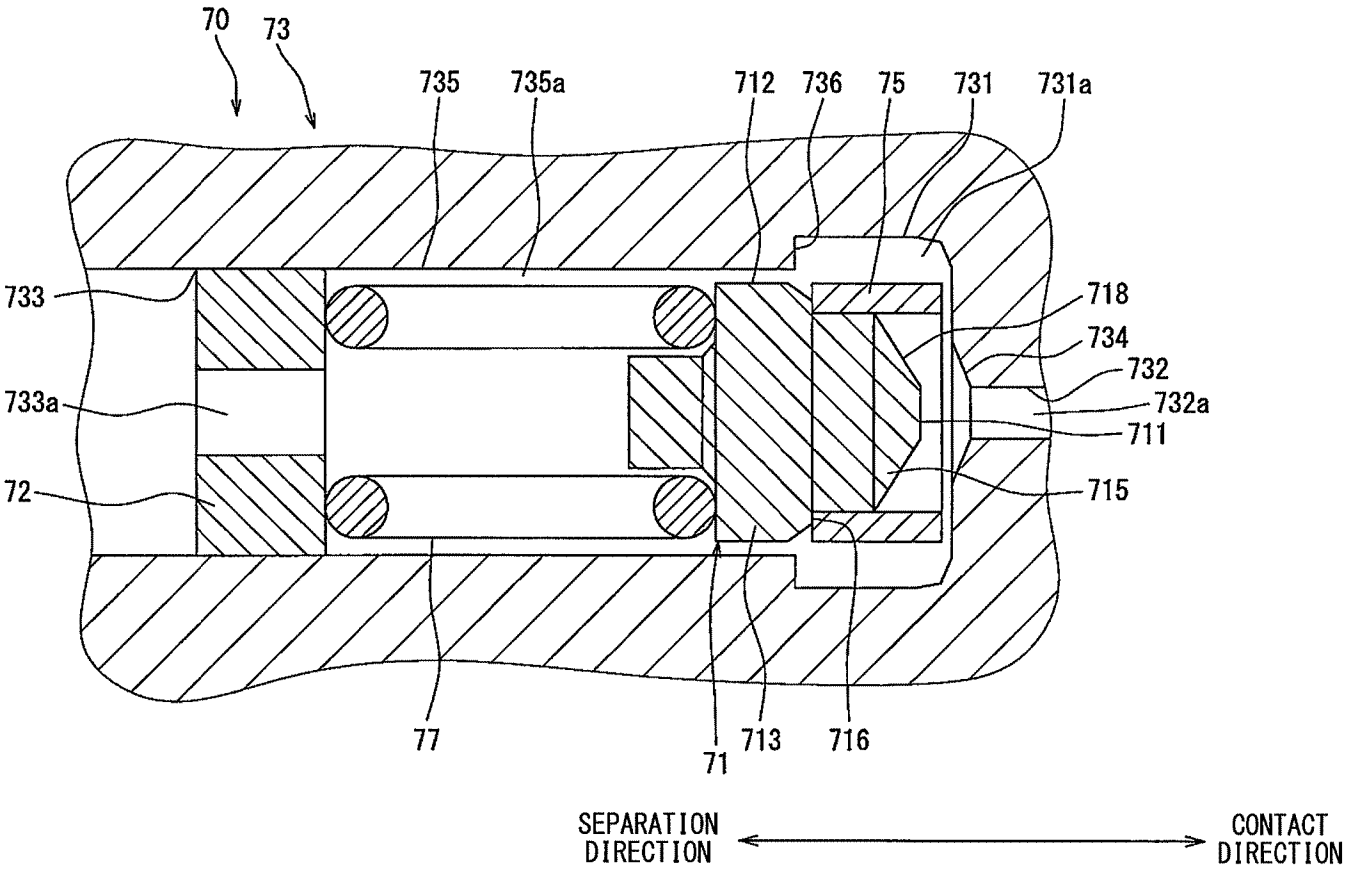
FIG. 4 is a diagram illustrating the pressure adjustment portion when an inlet is open according to the first embodiment.
Figure 5:
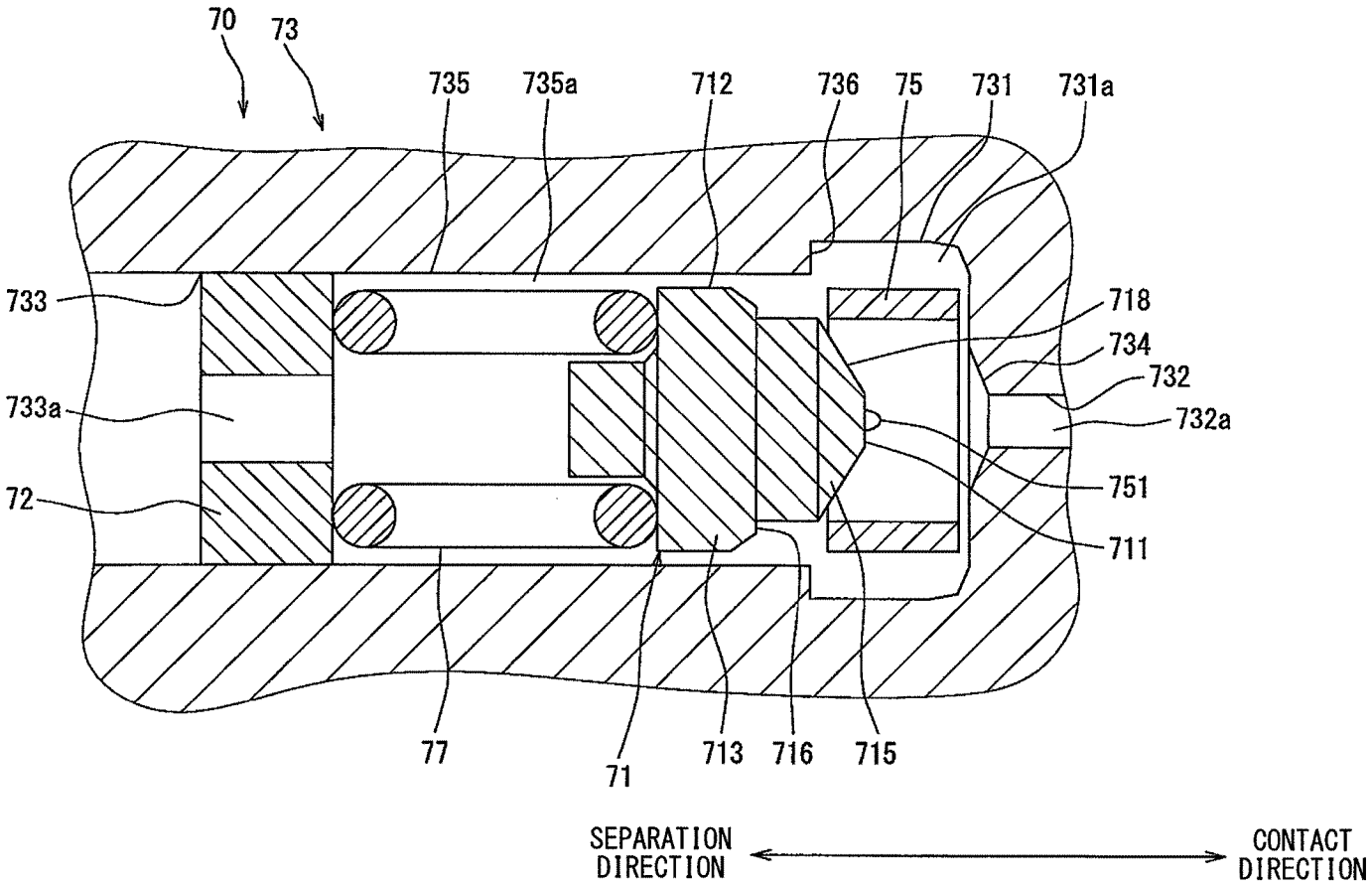
FIG. 5 is a diagram illustrating a pressure adjustment portion according to a modification of the present disclosure.
Figure 6:
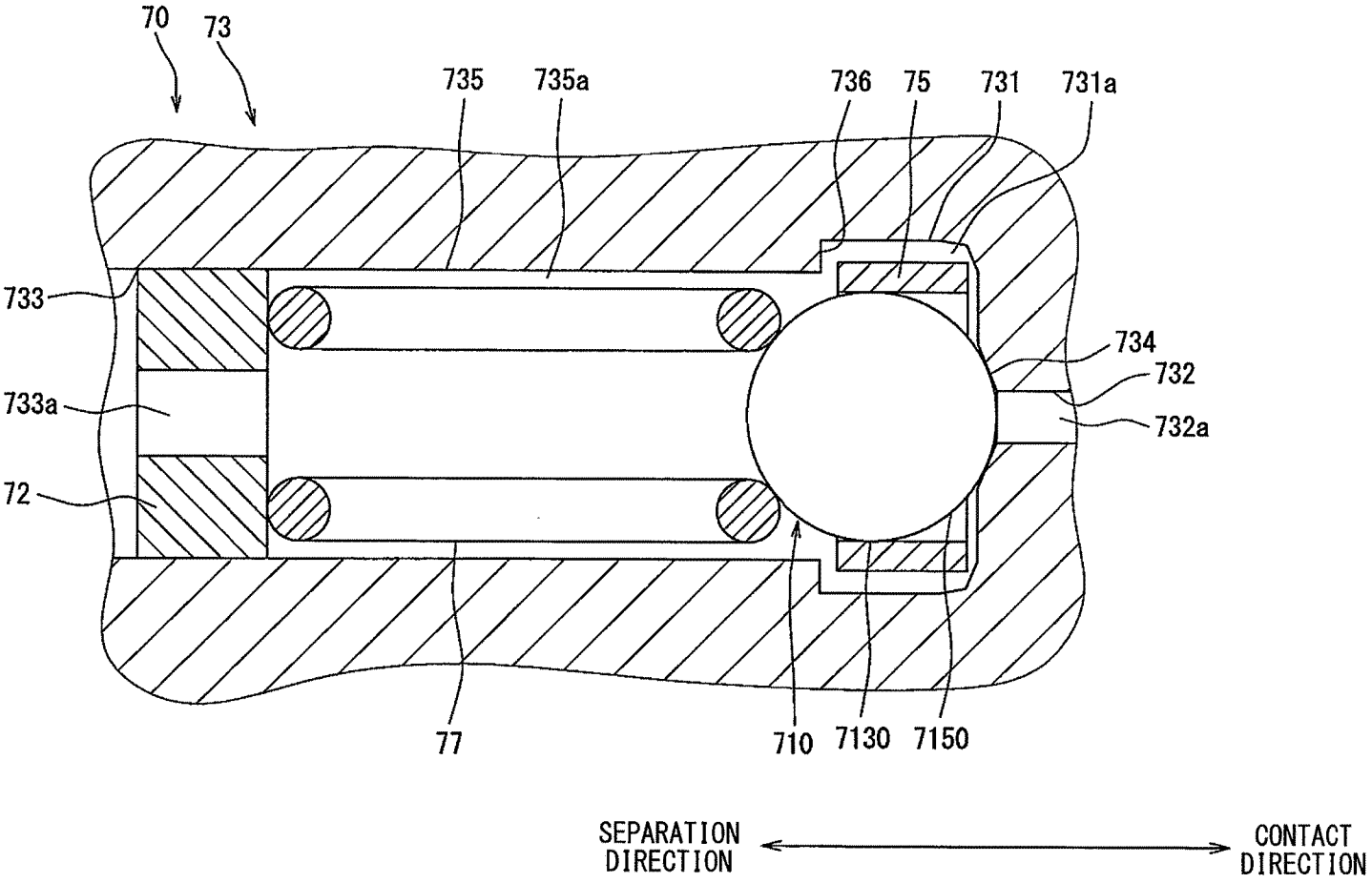
FIG. 6 is a diagram illustrating a pressure adjustment portion according to another modification of the present disclosure.

FIG. 3 is a diagram illustrating the valve hold member 75 viewed in "A" direction of the FIG. 2. As shown in FIG. 3, the valve hold member 75 has a gap thereon extending in the separation direction. The gap of the valve hold member 75 may extend in the separation direction from an edge portion of the valve hold member 75 facing in the contact direction. The gap of the valve hold member 75 may extend in the axial direction of the body portion 73 of the pressure adjustment portion 70. The fuel from the high pressure passage 34 flows to the low pressure passage 33 that is a space on the upstream side through the gap of the valve hold member 75. The valve hold member 75 may have a ring shape having a gap therein so that a cross-sectional shape of the valve hold member 75 in the radial direction is C-shape.

Effects of the high pressure pump 10 according to the present embodiment will be described below.

The high pressure pump 10 includes the pressurization portion 40, discharge portion 60, the body portion 73, the valve member 71, the urging member 77, the valve hold member 75, and the limiting portion 736. The pressurization portion 40 includes (defines) the pressurization room 42 whose volume is varied by a motion of the plunger 41, and accordingly the fuel can be pressurized in the pressurization room 42. The discharge portion 60 discharges the fuel pressurized in the pressurization room 42 into the fuel rail 20. The body portion 73 includes the downstream passage defining portion (downstream relief passage defining portion) 731 defining the downstream relief passage 731*a* through which the fuel flows from the high pressure passage 34 that is the space on the downstream side of the discharge portion 60 to the low pressure passage 33 that is the space on the upstream side of the discharge portion 60. The body portion 73 defines the inlet 732*a* through which the downstream relief passage 731*a* and the high pressure passage 34 communicate with each other. The body portion 73 includes the valve seat 734 having an annular shape and provided on the radially outer side of the inlet 732*a*. The body portion 73 defines the outlet 733*a* through which the downstream relief passage 731*a* and the low pressure passage 33 communicate with each other. The valve member 71 has the outer wall portion 713. The valve member 71 has the front end portion 715 having the outer diameter smaller than the outer diameter of the outer wall portion 713. The front end portion 715 is located between the outer wall portion 713 and the valve seat 734. The front end portion 715 of the valve member 71 closes the inlet 732*a* by contacting the valve seat 734. When the pressure of the fuel in the high pressure passage 34 is at or above the predetermined pressure, the front end portion 715 moves apart from the valve seat 734 and opens the inlet 732*a*. The urging member 77 urges the valve member 71 toward the valve seat 734. The valve hold member 75 grips the outer wall portion 713 so as to hold the outer wall portion 713 therein. The limiting portion 736 limits the motion of the valve hold member 75 in the separation direction.

According to this configuration, when the pressure in the high pressure passage 34 extraordinarily increases, the valve member 71 moves apart from the valve seat 734 and opens the inlet 732*a*. The valve hold member 75 moves in the separation direction together with the valve member 71. However, the motion of the valve hold member 75 in the separation direction is limited by the limiting portion 736. Therefore, the valve member 71 moves in the separation direction relative to the valve hold member 75 against the gripping force of the valve hold member 75. The valve member 71 has a dimension in the radial direction on the contact side smaller than a dimension in the radial direction on the separation side. Consequently, the valve hold member 75 is decreased in size in the radial direction.

When the valve member 71 moves in the contact direction after the valve member 71 once moves in the separation direction and comes out of contact with the valve seat 734, the valve member 71 is stopped by the edge portion of the valve hold member 75 facing in the separation direction. Consequently, the valve hold member 75 is interposed between the valve member 71 and the body portion 73, and the valve hold member 75 prevents the valve member 71 from contacting the valve seat 734. Accordingly, the pressure in the high pressure passage 34 can be prevented from increasing extraordinarily.

The valve member 71 includes the engagement surface 716 extending radially outward, and the engagement surface 716 is capable of contacting the edge portion of the valve hold member 75 when the valve hold member 75 holds the front end portion 715. The engagement surface 716 of the valve member 71 is located between a surface of the valve member 71 contacting the valve seat 734 and a part of the outer wall portion 713.

According to this configuration, the engagement surface 716 extending radially outward contacts the edge portion of the valve hold member 75 facing in the separation direction. Therefore, the valve hold member 75 once decreasing in size is limited not to increase in size by the valve member 71.

In the first embodiment, a groove (notch) 751 may be provided on an inner wall of the valve hold member 75. In this case, the fuel in the high pressure passage 34 is likely to flow into the low pressure passage 33 through the groove 751.

In the first embodiment, a ball valve 710 having a ball shape may be used as the valve member. In this case, the ball valve 710 includes a large diameter portion 7130 and a small diameter portion 7150 having whose diameter is small than the large diameter portion 7130.

In the first embodiment, the pressure adjustment portion 70 is located between the high pressure passage 34 and the low pressure passage 33. However, the position of the pressure adjustment portion 70 is not limited to this. For example, the pressure adjustment portion 70 may be located between the high pressure passage 34 and the pressurization room 42. In other words, the fuel in the high pressure passage 34 may return to the pressurization room 42 through the pressure adjustment portion 70. The pressurization room 42 may be used as the upstream passage.

What is claimed is:

1. A high pressure pump comprising:

a pressurization portion including a pressurization room whose volume is varied by a motion of a plunger to be capable of pressurizing a fuel;

a discharge portion discharging the fuel pressurized in the pressurization room to a fuel rail;

a body portion including:

a relief passage through which the fuel flows from a downstream passage located downstream of the discharge portion to an upstream passage located upstream of the discharge portion;

an inlet through which the relief passage and the downstream passage communicate with each other;

a valve seat that is provided on a radially outer side of the inlet and has an annular shape; and an outlet through which the relief passage and the upstream passage communicate with each other, a valve member including a large diameter portion and a small diameter portion, the small diameter portion being located between the valve seat and the large diameter portion and having an outer diameter smaller than an outer diameter of the large diameter portion, the small diameter portion contacting the valve seat so as to close the inlet of the body portion when a pressure in the downstream passage is below a predetermined pressure, the valve member moving apart from the valve seat in a separation direction so as to open the inlet of the body portion when the pressure in the downstream passage is at or above the predetermined pressure;

an urging member urging the valve member toward the valve seat;

a valve hold member surrounding and holding the large diameter portion; and a limiting portion capable of limiting a motion of the valve hold member in the separation direction, wherein:

the valve member includes an engagement surface located apart in the separation direction from the valve seat, the engagement surface being capable of contacting an edge portion of the valve hold member;

the valve hold member is capable of decreasing in size in a radial direction and holding the small diameter portion; and when the valve hold member holds the small diameter portion, the valve hold member contacts the engagement surface.

2. The high pressure pump according to claim 1, wherein the limiting portion is a surface extending from an inner wall of the body portion toward an axis of the body portion.

3. The high pressure pump according to claim 1, wherein the valve hold member has a ring shape surrounding an outer periphery of the valve member, the valve hold member includes a gap extending in the separation direction.

4. The high pressure pump according to claim 3, wherein the valve hold member includes a groove on an inner wall of the valve hold member.

5. The high pressure pump according to claim 1, wherein the valve member is provided in the relief passage, the limiting portion is a surface extending in the relief passage in a radial direction of the body portion, the limiting portion capable of stopping the motion of the valve hold member in the separation direction by contacting the valve hold member.

6. The high pressure pump according to claim 5, wherein the valve member is movable in the separation direction relative to the valve hold member against a holding force of the valve hold member when the limiting portion is in contact with the valve hold member.

7. The high pressure pump according to claim 1, wherein the valve member is located inside the valve hold member in a radial direction of the body portion.

8. The high pressure pump according to claim 1, wherein a cross-section of the valve hold member has a C-shape.

9. The high pressure pump according to claim 1, wherein the limiting portion extends in a direction perpendicular to the separation direction.

10. The high pressure pump according to claim 1, wherein the engagement surface extends in a radial direction of the body portion.

* * * * *